US005447481A

United States Patent [19]

Emter, Jr.

[11] Patent Number: 5,447,481

[45] Date of Patent: Sep. 5, 1995

[54] BENCH PRESS EXERCISE APPARATUS

[76] Inventor: James Emter, Jr., 2007 NW. 267th Cir., Ridgefield, Wash. 98642

[21] Appl. No.: 206,591

[22] Filed: Mar. 3, 1994

[51] Int. Cl.[6] ..... A63B 21/078

[52] U.S. Cl. ..... 482/104; 482/142

[58] Field of Search ..... 482/104, 142; 602/242, 602/243

[56] References Cited

U.S. PATENT DOCUMENTS

| | | | |
|---|---|---|---|
| 1,904,039 | 4/1933 | Bruder | 482/142 |
| 3,866,606 | 2/1975 | Hargest | 606/242 |
| 4,621,809 | 11/1986 | Pearl | 482/104 |
| 4,953,857 | 9/1990 | Lemire | 482/104 |
| 5,039,090 | 8/1991 | Roosevelt | 482/104 |
| 5,304,109 | 4/1994 | Shockley | 482/104 |

*Primary Examiner*—Lynne A. Reichard

*Attorney, Agent, or Firm*—Chernoff, Vilhauer, McClung & Stenzel

[57] ABSTRACT

A weight bench for use in performing a bench press exercise includes a narrow planar surface for supporting a user in a reclining position and includes a portion directly beneath the shoulders which is curved, having a center apex generally coextensive with the top of the bench and curving down and away on either side from the apex thus providing relieved zones directly beneath the shoulder blades of the user. This design effectively disengages the shoulder muscles and requires that the bench press exercise be accomplished strictly by the pectorals.

2 Claims, 1 Drawing Sheet

BENCH PRESS EXERCISE APPARATUS

The following invention relates to a bench press apparatus and more particularly to a support bench for a user performing a bench press exercise which includes a curved shoulder support portion that supports a user's shoulders at a plane lower than the rest of the user's body as it reclines along the bench.

BACKGROUND OF THE INVENTION

A bench press exercise is conventionally performed by a weight lifter by lying on his back along a narrow supporting bench while the weights are pressed upwards by the arms and chest muscles directly above the user's chest. The goal of a bench press exercise is to strengthen the pectoral muscles in the chest. In order to do this it is necessary to isolate the pectoral muscles during the bench press exercise so that other muscles, such as the shoulders, are not brought into play. Other exercises are designed for the shoulder muscles but the bench press is uniquely intended to strengthen the pectoral muscles in the chest region. Conventional bench press apparatus unfortunately supports the entire back of the user on the same horizontal plane and this includes support for the shoulders directly beneath the shoulder blades. When this occurs the shoulder muscles are engaged during the bench press lift and the pectoral muscles are not isolated as desired. Some weight benches such as that shown in Rogers U.S. Pat. No. 4,319,747 provide a curved supporting surface in a bench press apparatus which provides relief beneath the shoulders thus forcing the sternum upwards. The Rogers bench, however, is curved along its entire length with the attendant problem that a user could slip off to either side during the exercise. Also, the Rogers bench is a continuous curve and provides no support either for the shoulders or other parts of the body below the apex of the curve which would extend just beneath a user's spine.

SUMMARY OF THE PRESENT INVENTION

According to the present invention a weight bench is provided for use in performing a bench press exercise which includes a narrow planar surface for supporting a user in a reclining position and includes a portion beneath the shoulder region of a reclining user's body such that the portion is a curved support member having a center apex generally coextensive with the narrow planar surface and curving down and away on either side of the apex thereby providing relieved zones directly beneath the shoulder blades of the user.

The curved support member includes substantially planar end portions in the relieved zones directly beneath the shoulder blades which are substantially parallel to the narrow planar surface so that the shoulders of the user are supported during a bench press exercise, but on a lower plane than the rest of the body. This forces the user's sternum higher than the shoulders with the result that the bench press exercise is executed entirely by the chest.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
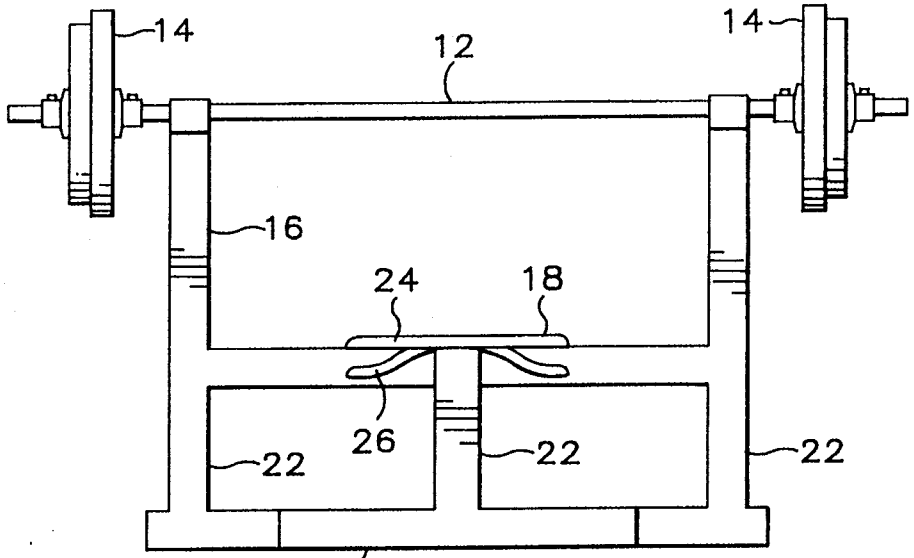
FIG. 1 is a front view of a bench press apparatus incorporating the present invention.

Referring to FIG. 1 a bench press apparatus 10 includes a weight bar 12 with barbells 14 held by support arms 16 above a bench 18. The bench 18 is supported by a frame 20 which includes legs 22.

Figure 2:
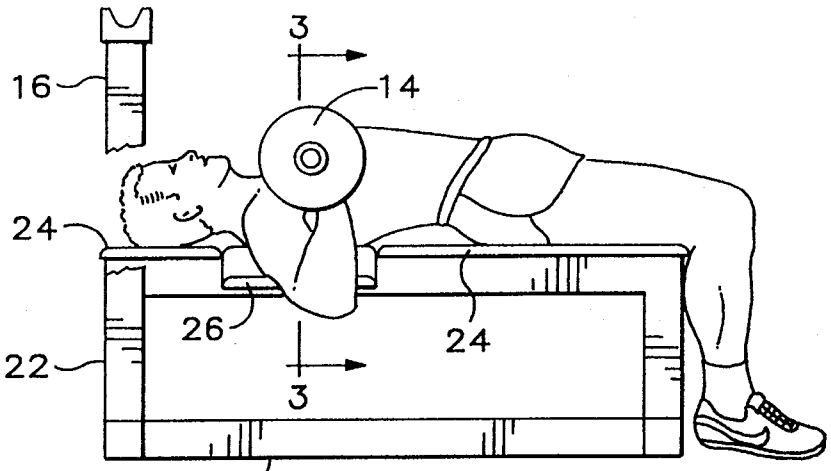
FIG. 2 is a partial side view of the bench press apparatus of FIG. 1 depicting a user executing a bench press exercise.
Figure 3:
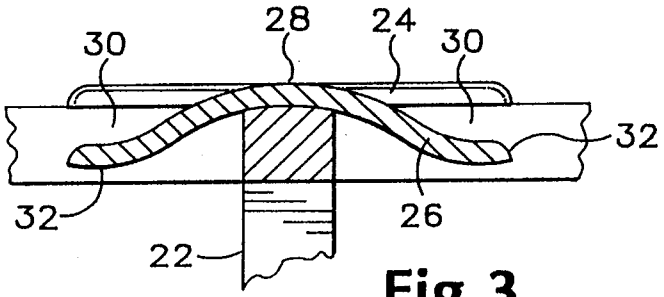
FIG. 3 is a partial cutaway view taken along line 3—3 of FIG. 2.

The bench 18 includes a narrow planar surface 24 that extends along the length thereof for supporting a user in a reclining position. The bench 18 includes a curved portion 26 (refer to FIGS. 2 and 3) directly underneath the shoulders of the user. The curved portion 26 includes a center apex which supports the user's spine and which is level and coextensive with the narrow planar surface 24. The curved support portion 26 curves down and away from the apex 28 on either side thereof to provide relieved zones 30 directly underneath the user's shoulder blades. The curved portion 26 includes end portions 32 which are generally level, and in a plane which is parallel to the plane of the narrow planar surface 24, but which are lowered with respect thereto. This is accomplished by having the curved portion curve in a first direction down and away from the apex 28 and then reversing the curve to form the substantially flat end portions 32 at a level below the support surface 24.

According to this design, the body is supported along a flat surface as the user lies on his back to perform the bench press exercise except for the portion immediately underneath the shoulder blades, where the shoulders are supported on a lower plane thus forcing the sternum upwards. When the bench press exercise is performed all of the weight must be lifted by the pectoral muscles in the chest and the shoulder muscles are completely disengaged. This results in a more efficient bench press exercise that specifically strengthens the intended muscles.

Figure 4:
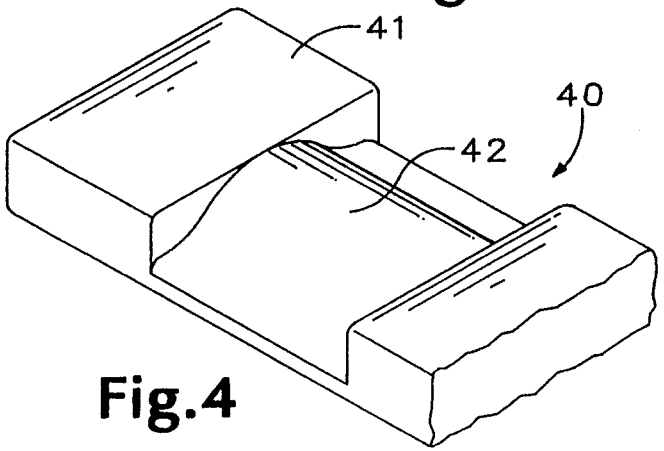
FIG. 4 is a partial perspective view of a second embodiment of the invention showing the upper surface of a weight training bench.

A second embodiment of the invention is shown in FIG. 4 which shows a padded surface 40 made from a mold which includes both a flat support portion 41 and a curved portion 42. The curved portion 42 has the same "gull wing" shape as the portion 26 with the only difference being that the entire padded surface 40 is produced from a single mold.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A weight bench for use in performing a bench press exercise comprising a narrow planar surface for supporting a user in a reclining position, said surface having a central body support axis and including a convex curved shoulder support portion having a center apex linearly coextensive with the central body support axis and curving down and away on either side of the apex, and a pair of concave curved portions, one on either side of said apex, said concave curved portions terminating in substantially flat vertically relieved zones below said planar surface.

2. The weight bench of claim 1 wherein the narrow planar surface is substantially continuously flat across its entire width except for said convex curved shoulder support portion.

* * * * *